US011006688B2

(12) United States Patent
Lim

(10) Patent No.: US 11,006,688 B2
(45) Date of Patent: May 18, 2021

(54) HEADWEAR WITH A SET OF HAIR PORTS

(71) Applicant: New Vision Technologies, LLC, Las Vegas, NV (US)

(72) Inventor: Katy Craft Lim, Las Vegas, NV (US)

( * ) Notice: Subject to any disclaimer, the term of this patent is extended or adjusted under 35 U.S.C. 154(b) by 119 days.

(21) Appl. No.: 16/412,113

(22) Filed: May 14, 2019

(65) Prior Publication Data

US 2019/0365006 A1 Dec. 5, 2019

Related U.S. Application Data

(60) Provisional application No. 62/679,171, filed on Jun. 1, 2018.

(51) Int. Cl.

| | |
|---|---|
| ***A42B 1/22*** | (2006.01) |
| ***A42B 1/002*** | (2021.01) |
| *A42B 1/24* | (2021.01) |

(52) U.S. Cl.

CPC ..... *A42B 1/002* (2013.01); *A42B 1/225* (2013.01)

(58) Field of Classification Search

CPC ..... A42B 1/225; A42B 1/004; A42B 1/241; A42B 7/00; A42B 1/00; A42B 1/02; A42B 1/061; A42B 1/062; A42B 1/066; A42B 1/206; A42B 1/24; A42B 1/008; A42B 1/067; A42B 1/22; A42B 1/006; A42B 1/002; A42C 5/04; A42C 5/00; A45D 8/00; A45D 8/34; A45D 8/40; Y10S 2/918

See application file for complete search history.

(56) References Cited

U.S. PATENT DOCUMENTS

| | | | | |
|---|---|---|---|---|
| 5,170,509 | A * | 12/1992 | Leopold | A41G 5/0093 132/273 |
| 5,239,705 | A * | 8/1993 | Leopold | A41G 5/0093 132/273 |
| 5,493,735 | A * | 2/1996 | Rice | A41G 5/0093 2/174 |
| 6,006,362 | A * | 12/1999 | Walsh | A42B 1/248 2/181 |
| 6,240,566 | B1 * | 6/2001 | Scantlin | A42B 1/225 2/171 |
| 7,178,172 | B2 * | 2/2007 | Laing | A42B 1/225 132/273 |
| D541,013 | S * | 4/2007 | Kim | D2/882 |
| 7,945,971 | B2 * | 5/2011 | Garza | A42B 1/225 2/209.3 |
| D797,411 | S * | 9/2017 | Shedd | D2/882 |
| 10,076,148 | B2 * | 9/2018 | Belle, Jr. | A42B 1/061 |
| 10,098,400 | B2 * | 10/2018 | Johnson | A42B 1/206 |
| 10,342,276 | B2 * | 7/2019 | Buri | A42B 1/068 |
| 10,413,032 | B2 * | 9/2019 | Keenan | A45D 8/00 |
| D863,733 | S * | 10/2019 | Konopka | D2/882 |

(Continued)

FOREIGN PATENT DOCUMENTS

KR 3020150025366 † 12/2015

*Primary Examiner* — Robert H Muromoto, Jr.

(57) ABSTRACT

Hats including hair ports are disclosed herein. One hat includes a first portion, a second portion, and a set of straps coupling the first portion and the second portion. Here, the set of straps, the first portion, and the second portion create a set of ports located at a rear portion of the hat that extends from a crown of the hat to a bottom of the hat. Further, at least one port in the set of ports includes a size that allows the hair of a person wearing the hat to be placed there through.

10 Claims, 6 Drawing Sheets

(56) References Cited

U.S. PATENT DOCUMENTS

2002/0162155 A1* 11/2002 Griffin ..... A42B 1/225 2/171
2003/0106134 A1* 6/2003 Kim ..... A42B 1/066 2/171
2004/0006809 A1* 1/2004 Crenshaw ..... A42C 5/04 2/209.3
2005/0066421 A1* 3/2005 Brundage ..... A42B 1/225 2/209.3
2005/0108810 A1* 5/2005 Yan ..... A42B 1/062 2/195.4
2006/0010566 A1* 1/2006 Ridgeway ..... A42B 1/225 2/171
2006/0117461 A1* 6/2006 Kelly ..... A42B 1/225 2/209.13
2006/0137074 A1* 6/2006 Laing ..... A42B 7/00 2/195.2
2006/0191057 A1* 8/2006 Lynn ..... A41G 5/0093 2/171
2007/0061944 A1* 3/2007 Briskie ..... A42B 1/225 2/209.3
2008/0201825 A1* 8/2008 Chun ..... A42B 1/225 2/209.13
2009/0151047 A1* 6/2009 Garza ..... A42B 1/225 2/174
2009/0199323 A1* 8/2009 Zakarian ..... A45D 8/40 2/209.14
2010/0205715 A1* 8/2010 Dillavou ..... D04B 7/08 2/69
2012/0278970 A1* 11/2012 Bischel ..... A42B 1/225 2/183
2013/0025026 A1* 1/2013 Smith ..... A42B 1/225 2/209.3
2013/0074246 A1* 3/2013 Rogers ..... A42B 1/225 2/209.3
2014/0130235 A1* 5/2014 Johnson ..... A42B 1/241 2/209.3
2014/0223637 A1* 8/2014 Belle, Jr. ..... A42B 1/061 2/195.1
2015/0113706 A1* 4/2015 Rogers ..... A42B 1/00 2/209.3
2016/0255895 A1* 9/2016 Shedd ..... A42B 1/22
2019/0037951 A1* 2/2019 Rue ..... A42B 1/062
2020/0022442 A1* 1/2020 McBride ..... A42B 1/225
2020/0214382 A1* 7/2020 Dann ..... A42B 1/02

* cited by examiner
† cited by third party

HEADWEAR WITH A SET OF HAIR PORTS

CROSS-REFERENCE TO RELATED APPLICATIONS

The present application claims priority to and the benefit of U.S. Provisional Patent Application No. 62/679,171, filed on Jun. 1, 2018, the contents of which are incorporated herein by reference in their entirety.

FIELD OF THE TECHNOLOGY

The present technology relates generally to headwear, and more particularly to, headwear with a set of ports for hair.

BACKGROUND

Headwear comes in many shapes and sizes. While wearing headwear, a person may additionally desire to style his/her hair with a ponytail. A ponytail is usually located on the back of a person's head. Additionally, the ponytail can be placed anywhere on the back of the person's head. In various examples, the ponytail may be located high on the back, in the middle of the back, low on the back of the person's head, or somewhere in between. The location of a ponytail may, at times, make it inconvenient to style one's hair while wearing headwear because the ponytail will typically be placed in and occupy space within the headwear, which can be uncomfortable and/or not possible because of the amount of space that the ponytail may occupy within the headwear. As such, there is a need for headwear to include a mechanism for allowing a ponytail to be located external to a piece of headwear while a person is wearing the headwear regardless of where the ponytail is located.

BRIEF DESCRIPTION OF THE DRAWINGS

To readily understand the advantages and benefits of the technology, a more particular description of the technology briefly described above will be rendered by reference to specific embodiments that are illustrated in the appended drawings. Understanding that these drawings depict typical embodiments of the technology, and are therefore not to be considered to be limiting of its scope, the technology will be described and explained with additional specificity and detail through the use of the accompanying drawings, in which.

DETAILED DESCRIPTION OF THE DRAWINGS

Figure 1A:
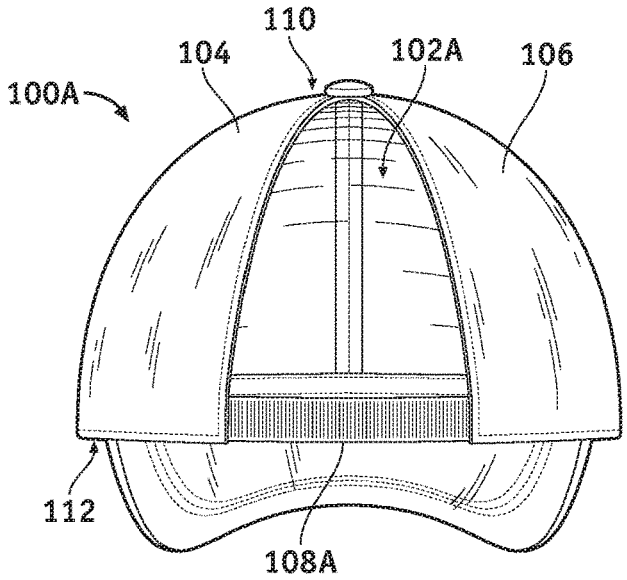
FIGS. 1A through 1L are diagrams illustrating various embodiments of headwear including one or more hair ports.

It should be understood that the language used in the present disclosure has been principally selected for readability and instructional purposes, and not to limit the scope of the subject matter disclosed herein in any manner. Further, reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including, but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

In addition, as used herein, the term "set" can mean "one or more," unless expressly specified otherwise. The term "sets" can mean multiples of or a plurality of "one or mores," "ones or more," and/or "ones or mores" consistent with set theory, unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

The present technology may include any type of headwear and is not limited to the style of headwear depicted in the drawings. Furthermore, the described features, structures, or characteristics of the various embodiments may be combined in any suitable manner. One skilled in the relevant art will recognize, however, that embodiments may be practiced without one or more of the specific details, or with other methods, components, materials, and so forth. In other instances, well-known structures, and/or materials are not shown or described in detail to avoid obscuring aspects of an embodiment.

Turning now to the Figures, FIG. 1A is a diagram illustrating one embodiment of a hat 100A (e.g., a piece of headwear). At least in the illustrated embodiment, the hat 100A includes, among other components, a port 102A (e.g., an aperture, a hole, mouth, space, gap, cavity, split, cleft, space, vent, notch, void, window, outlet, peephole, vacancy, vacuity, etc.).

In various embodiments, the port 102A may be bound by portions 104 and 106 of the hat 100A and a strap 108A that connect portions 104 and 106 to one another. The strap 108A may include and/or be formed of any suitable material or combination of materials that is known or developed in the future capable of connecting portions 104 and 106 to one another. In some embodiments, the strap 108A, may include a static material or a flexible/elastic material.

In embodiments employing a flexible/elastic strap 108A, the strap 108A can allow the size of the port 102A to be adjusted. The size/area of the port 102A can be adjustable depending upon the size of a person's head, the amount of hair on a person's head, and/or the size/amount of hair in a person's ponytail. During use, a person can place a ponytail or other hair style through the port 102A.

The port 102A may be included at any location on the hat 100A. In various embodiments, the port 102A is located at the back/rear or substantially the back/rear of the hat 100A to accommodate a ponytail, which is typically worn/styled on the back/rear of a person's head. As shown, the port 102A can extend from the crown 110 of the hat 100A to the strap 108A located at the bottom 112 of the hat 100A.

The hat 100A, including portions 104 and 106, may include any suitable material or combination of materials that is known or developed in the future. In various non-limiting examples, the hat 100A may include cloth formed of natural and/or artificial materials, fur, metal, plastic, and/or paper, etc., among other materials or combinations of materials that are possible and contemplated herein. That is, the various embodiments of hat 100A may include any type of material that can be utilized in headwear and/or that can be worn on a person's head.

While the hat 100A is illustrated as a ball cap, various other embodiments of the hat 100A may include a different style of headwear. That is, the various embodiments of the hat 100A are not limited to a ball cap. In other words, the hat 100A may include any suitable style of headwear and/or accessory that can be worn on a person's head that is known or developed in the future. Non-limiting examples of headwear may include stocking caps, beanies, visors, cowboy hats, berets, helmets, hard hats, etc., among other types/styles of headwear that are possible and contemplated herein.

Figure 1B:
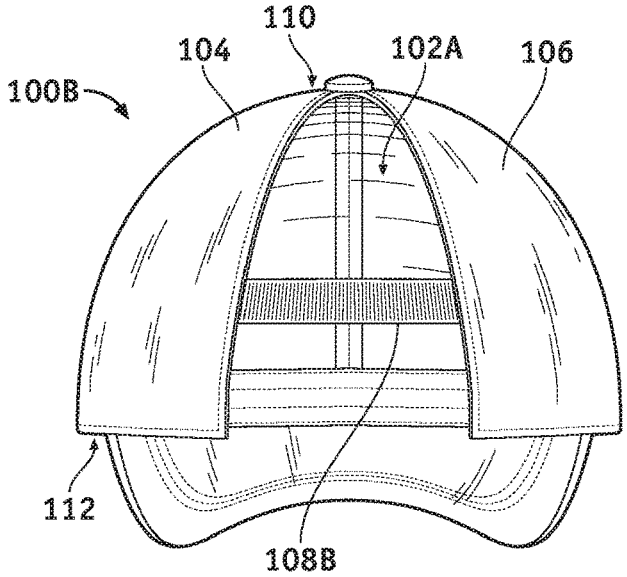

With reference to FIG. 1B, FIG. 1B is a diagram of another embodiment of a hat 100B. The hat 100B includes port 102A, portions 104 and 106, crown 110, and bottom 112 similar to hat 100A discussed above. In addition, hat 100B includes a strap 108B similar to strap 108A discussed above, but is placed at a different location than strap 108A.

As shown, strap 108B is located between the crown 110 and the bottom 112 of the hat 100B. In some embodiments, the strap 108B may be located at the midpoint between the crown 110 and the bottom 112. In other embodiments, the strap 108B may be located between the midpoint and the bottom 112. During use, a person can place a ponytail or other hair style through the port 102A and/or the space created between the strap 108B and the bottom 112.

Figure 1C:
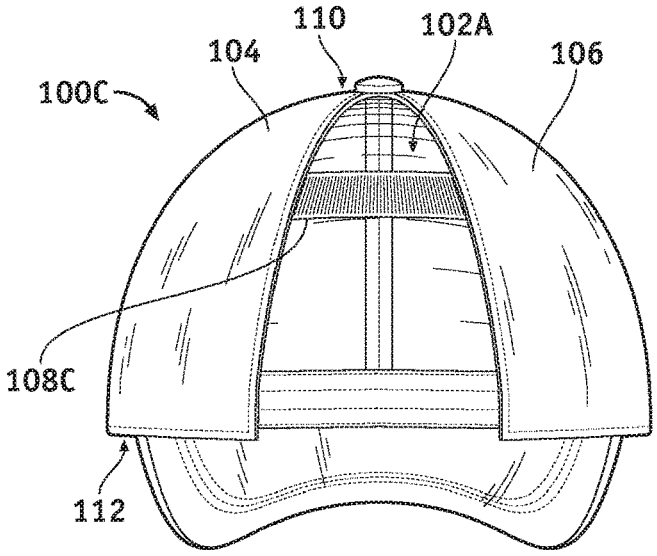

Referring to FIG. 1C, FIG. 1C is a diagram of another embodiment of a hat 100C. The hat 100C includes port 102A, portions 104 and 106, crown 110, and bottom 112 similar to hat 100A discussed above. In addition, hat 100C includes a strap 108C similar to strap 108A discussed above, but is placed at a different location than strap 108A.

As shown, strap 108C is located between the crown 110 and the bottom 112 of the hat 100B. In some embodiments, the strap 108C may be located at the midpoint between the crown 110 and the bottom 112. In other embodiments, the strap 108C may be located between the midpoint and the crown 110. During use, a person can place a ponytail or other hair style through the port 102A and/or the space created between the strap 108C and the bottom 112.

Figure 1D:
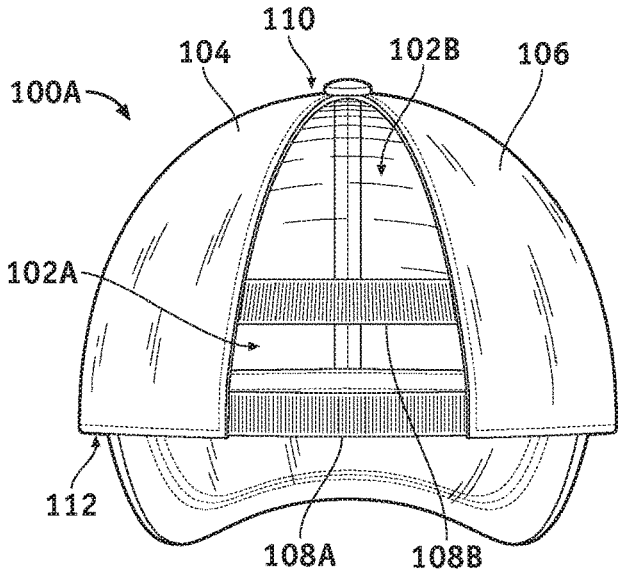

With reference to FIG. 1D, FIG. 1D is a diagram of another embodiment of a hat 100D. The hat 100D includes portions 104 and 106, strap 108A, crown 110, and bottom 112 similar to hat 100A discussed above.

In addition, hat 100D includes a strap 108B similar to the various embodiments of strap 108B discussed above. That is, strap 108B is located between the crown 110 and the bottom 112 of the hat 100D. In some embodiments, the strap 108B may be located at the midpoint between the crown 110 and the bottom 112. In other embodiments, the strap 108B may be located between the midpoint and the bottom 112.

The inclusion of strap 108B creates a plurality of ports (e.g., port 102A and 102B) at the back of the hat 100D. As shown, the port 102A is located between the straps 108A and 108B, while the port 102B is located between the strap 108B and the crown 110. During use, a person can place a ponytail or other hair style through the port 102A and/or the port 102B.

Figure 1E:
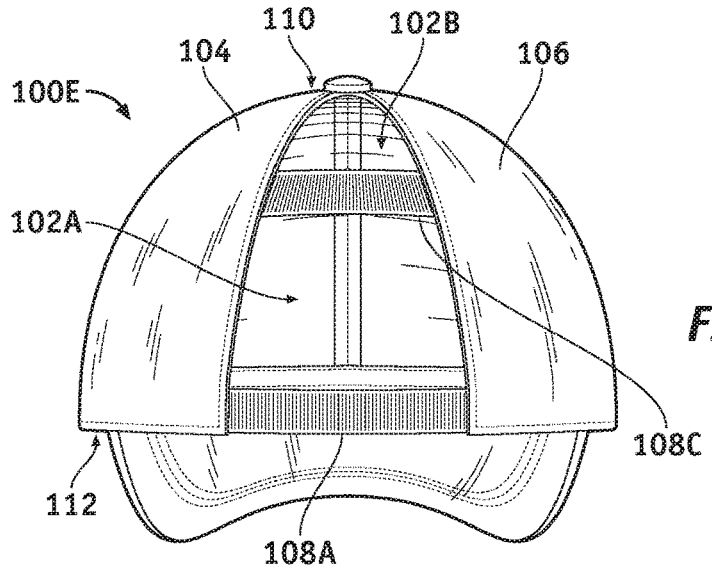

Referring to FIG. 1E, FIG. 1E is a diagram of another embodiment of a hat 100E. The hat 100E includes portions 104 and 106, strap 108A, crown 110, and bottom 112 similar to hat 100A discussed above.

In addition, hat 100E includes a strap 108C similar to the various embodiments of strap 108 discussed above. That is, strap 108C is located between the crown 110 and the bottom 112 of the hat 100E. In some embodiments, the strap 108C may be located at the midpoint between the crown 110 and the bottom 112. In other embodiments, the strap 108C may be located between the midpoint and the crown 110.

The inclusion of strap 108C creates a plurality of ports (e.g., port 102A and 102B) at the back of the hat 100E. As shown, the port 102A is located between the straps 108A and 108B, while the port 102B is located between the strap 108B and the crown 110. During use, a person can place a ponytail or other hair style through the port 102A and/or the port 102B.

Figure 1F:
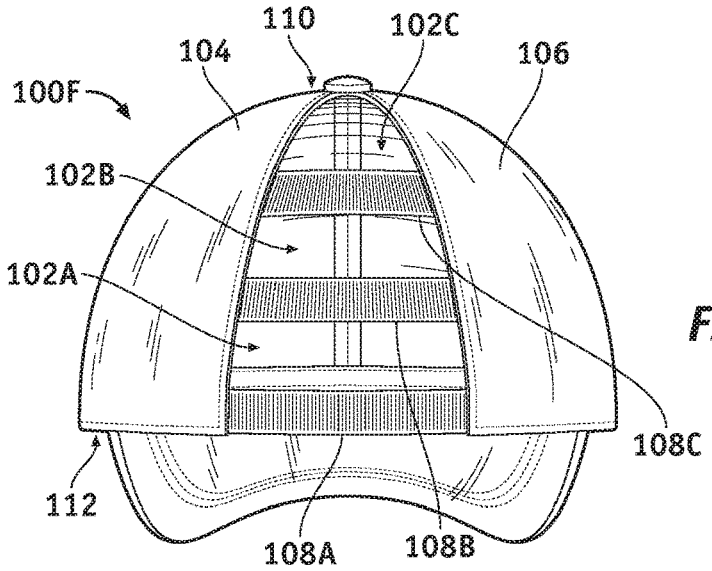

With reference to FIG. 1F, FIG. 1F is a diagram of another embodiment of a hat 100F. The hat 100F includes portions 104 and 106, straps 108A-108C, crown 110, and bottom 112 similar to various embodiments discussed above.

As shown, straps 108B and 108C are located between the crown 110 and the bottom 112 of the hat 100F. In some embodiments, strap 108B or 108C may be located at the midpoint between the crown 110 and the bottom 112, while the other strap 108 may be located between the midpoint and the bottom 112 (e.g., strap 108B) or the midpoint and the crown 110 (e.g., strap 108C).

The inclusion of straps 108B and 108C creates a plurality of ports (e.g., port 102A, port 108B, and 102C) at the back of the hat 100F. As shown, the port 102A is located between the straps 108A and 108B, the port 102B is located between the straps 108B and 108C, and port 102C is located between the strap 108C and the crown 110. During use, a person can place a ponytail or other hair style through the port 102A, the port 102B, and/or the port 102C.

Figure 1G:
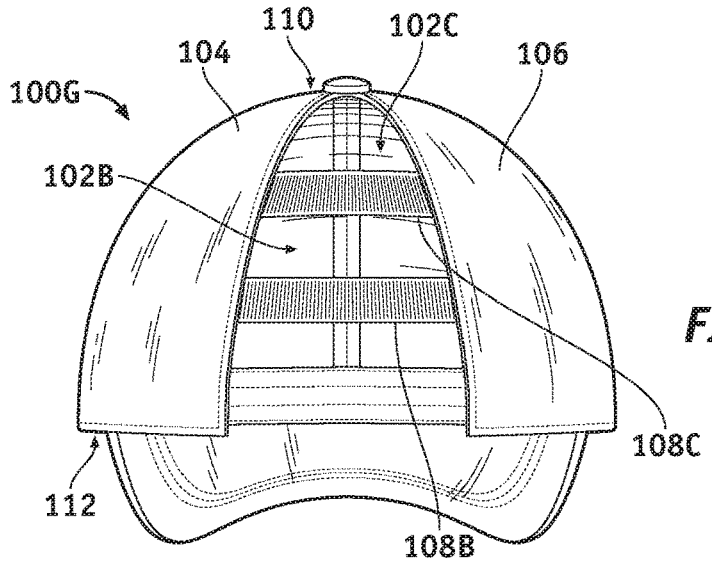

Referring to FIG. 1G, FIG. 1G is a diagram of another embodiment of a hat 100G. The hat 100G includes portions 104 and 106, straps 108B and 108C, crown 110, and bottom 112 similar to various embodiments discussed above.

As shown, straps 108B and 108C are located between the crown 110 and the bottom 112 of the hat 100G. In some embodiments, the strap 108B or 108C may be located at the midpoint between the crown 110 and the bottom 112, while the other strap 108 may be located between the midpoint and the bottom 112 (e.g., strap 108B) or the midpoint and the crown 110 (e.g., strap 108C).

The inclusion of straps 108B and 108C creates a plurality of ports (e.g., port 102B and 102C) at the back of the hat 100E. As shown, the port 102B is located between the straps 108B and 108C, while the port 102C is located between the strap 108C and the crown 110. During use, a person can place a ponytail or other hair style through the port 102B and/or the port 102C. During use, a person can place a ponytail or other hair style through the port 102A and/or the space created between the strap 108B and the bottom 112.

Figure 1H:
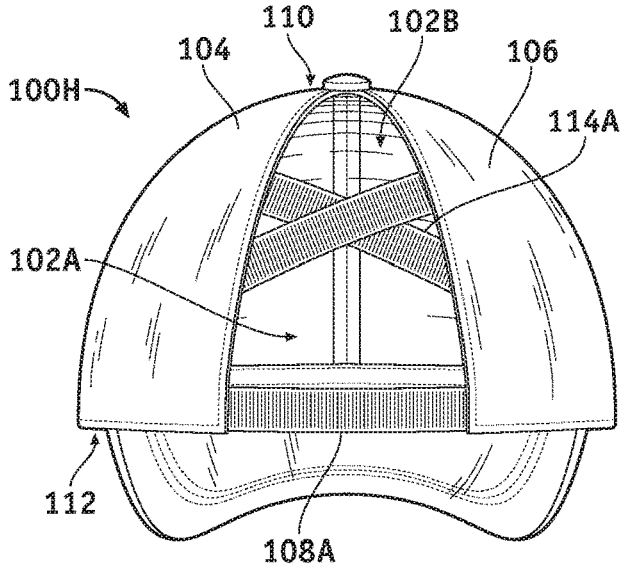

With reference to FIG. 1H, FIG. 1H is a diagram of another embodiment of a hat 100H. The hat 100H includes portions 104 and 106, strap 108A, crown 110, and bottom 112 similar to hat 100A discussed above.

In addition, hat 100H includes a crisscross 114A of straps 108 (e.g., straps 108B and 108C) similar to the various embodiments of a strap 108 discussed above. That is, crisscross 114A is located between the crown 110 and the bottom 112 of the hat 100H. In some embodiments, the strap 108H may be located at the midpoint between the crown 110 and the bottom 112. In other embodiments, the strap 108B may be located between the midpoint and the bottom 112. In still other embodiments, the strap 108B may be located between the midpoint and the crown 110.

The inclusion of crisscross 114A creates a plurality of ports (e.g., port 102A and 102B) at the back of the hat 100H. As shown, the port 102A is located between the strap 108A and crisscross 114A, while the port 102B is located between the crisscross 114A and the crown 110. During use, a person can place a ponytail or other hair style through the port 102A and/or the port 102B.

Figure 1I:
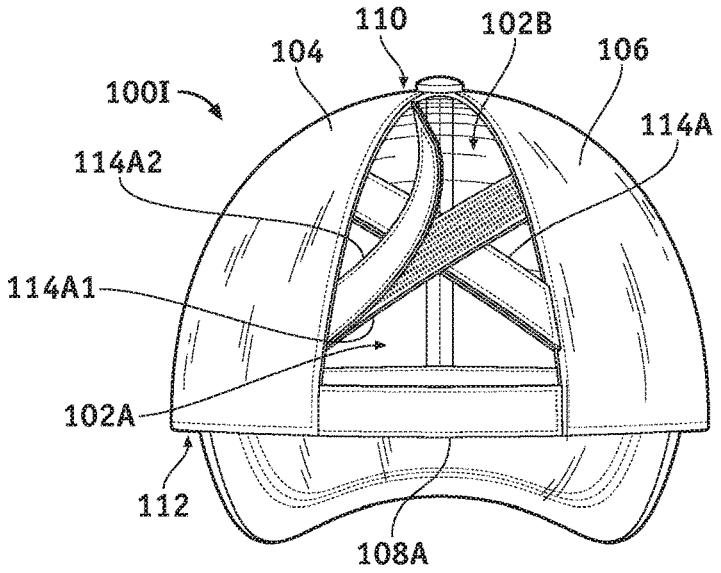

Referring to FIG. 1I, FIG. 1I is a diagram of another embodiment of a hat 100I. The hat 100I includes portions 104 and 106, strap 108A, crisscross 114A, crown 110, and bottom 112 similar to hat 100H discussed above.

Crisscross 114A includes a top layer 114A1 and a bottom layer 114A2. The top layer 114A1 is configured to lay over the bottom layer 114A2. Further, the top layer 114A1 and the bottom layer 114A2 are detachably coupleable to one another such that the size of the hat 100I is adjustable. The adjustable size, in various embodiments, can include an adjustable volume and/or circumference of the hat 100I.

In various embodiments, the top layer 114A1 and the bottom layer 114A2 are detachably coupleable to one another and adjustable using any suitable adjustment mechanism that is known or developed in the future. In various embodiments, the top layer 114A1 and the bottom layer 114A2 are detachably coupleable to one another and adjustable using a hook and loop mechanism (e.g., Velcro®), a button, a slide, and/or an adjustment mechanism (see e.g., adjustment mechanism 209 in FIGS. 2A and 2C).

As shown, hat 100I includes port 102A and port 102B at the back of the hat 100I. During use, a person can place a ponytail or other hair style through the port 102A and/or the port 102B.

Figure 1J:
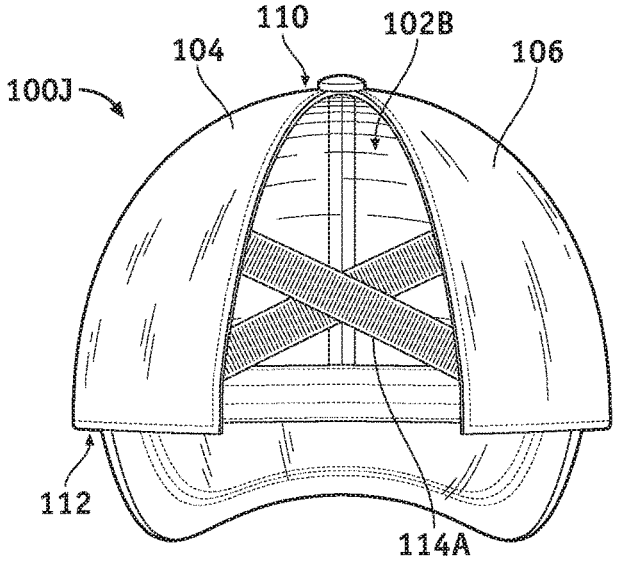

Referring to FIG. 1J, FIG. 1J is a diagram of another embodiment of a hat 100J. The hat 100I includes portions 104 and 106, crisscross 114A, crown 110, and bottom 112 similar to hat 100H discussed above.

As shown, hat 100J includes port 102B at the back of the hat 100J. During use, a person can place a ponytail or other hair style through the port 102B and/or the space created between the crisscross 114A and the bottom 112.

Figure 1K:
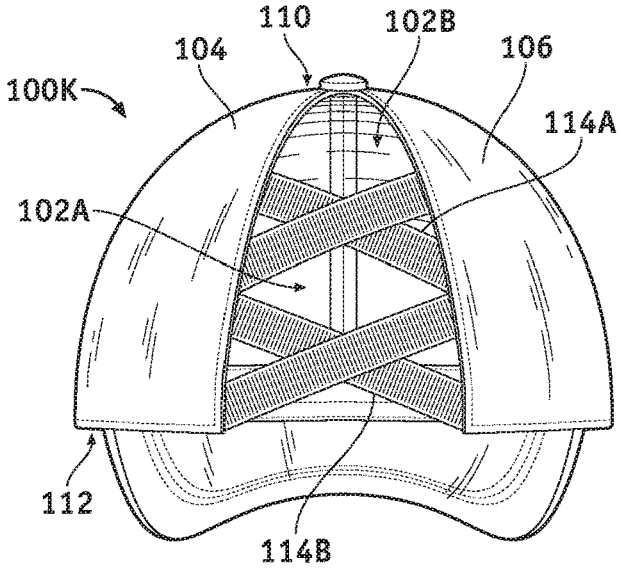
Figure 1L:
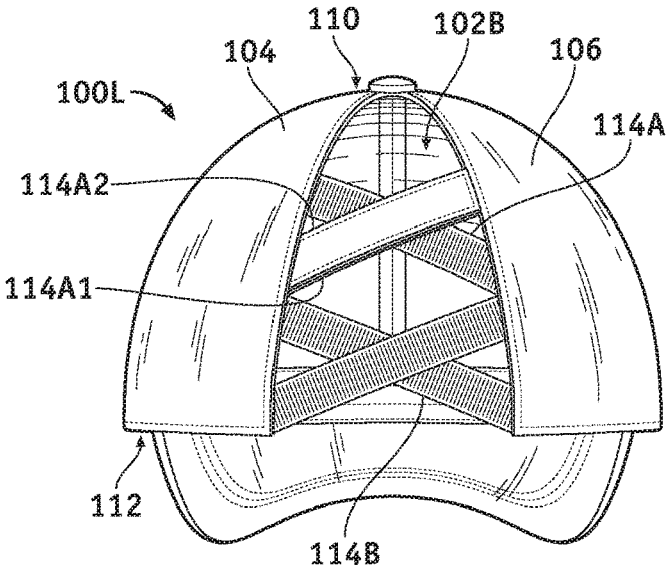

With reference to FIG. 1K, FIG. 1K is a diagram of another embodiment of a hat 100K. The hat 100K includes portions 104 and 106, crisscross 114A, crown 110, and bottom 112 similar to various embodiments discussed above.

In addition, hat 100K includes a crisscross 114B of straps 108 located between the crown 110 and the bottom 112 of the hat 100K. In some embodiments, the crisscross 114A or 114B may be located at the midpoint between the crown 110 and the bottom 112, while the other crisscross 114 may be located between the midpoint and the bottom 112 (e.g., crisscross 114B) or the midpoint and the crown 110 (e.g., crisscross 114A).

The inclusion of crisscross 114A and crisscross 114B creates a plurality of ports (e.g., port 102A and 102B) at the back of the hat 100K. As shown, the port 102A is located between crisscross 114A and crisscross 114B, while the port 102B is located between the crisscross 114A and the crown 110. During use, a person can place a ponytail or other hair style through the port 102A, the port 102B or in the space created between crisscross 114B and the bottom 112.

Figure 2A:
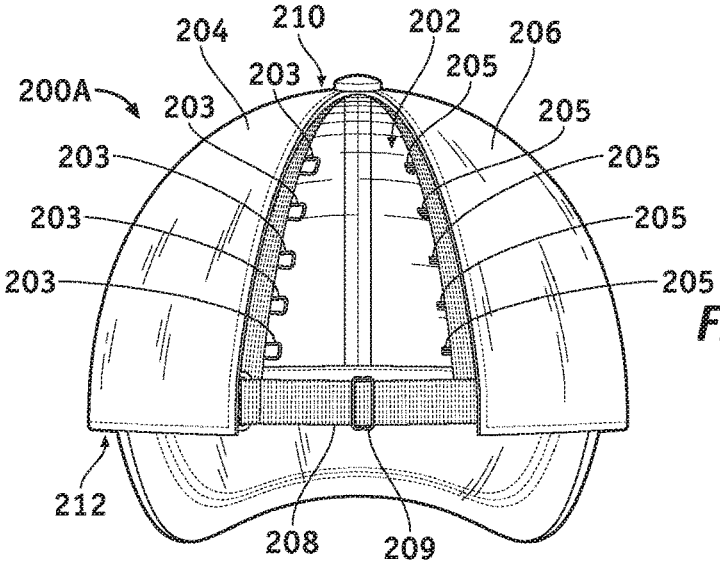
FIGS. 2A through 2C are diagrams illustrating various other embodiments of headwear including one or more hair ports.

Referring to FIG. 2A, FIG. 2A is a diagram illustrating one embodiment of a hat 200A (e.g., a piece of headwear). At least in the illustrated embodiment, the hat 200A includes, among other components, a port 202 (e.g., an aperture, a hole, mouth, space, gap, cavity, split, cleft, space, vent, notch, void, window, outlet, peephole, vacancy, vacuity, etc.).

In various embodiments, the port 202 may be bound by portions 204 and 206 of the hat 200A and a strap 208 that connect portions 204 and 206 to one another. The strap 208 may include and/or be formed of any suitable material or combination of materials that is known or developed in the future capable of connecting portions 204 and 206 to one another. In some embodiments, the strap 208, may include a static material or a flexible/elastic material.

In embodiments employing a flexible/elastic strap 208, the strap 208 can allow the size of the port 202 to be adjusted. The size/area of the port 202 can be adjustable depending upon the size of a person's head, the amount of hair on a person's head, and/or the size/amount of hair in a person's ponytail. During use, a person can place a ponytail or other hair style through the port 202.

In some embodiments, the strap 208 may include an adjustment mechanism 209. The adjustment mechanism 209 may include any suitable mechanism that allows the length of the strap 208 to be adjusted (e.g., lengthened or shortened).

The port 202 may be included at any location on the hat 200A. In various embodiments, the port 202 is located at the back/rear or substantially the back/rear of the hat 200A to accommodate a ponytail, which is typically worn/styled on the back/rear of a person's head. As shown, the port 202 can extend from the crown 210 of the hat 200A to the strap 208 located at the bottom 212 of the hat 200A.

The hat 200A, including portions 204 and 206, may include any suitable material or combination of materials that is known or developed in the future similar to the various embodiments of the hat 100A-100L. Similarly, while the hat 200A is illustrated as a ball cap, various other embodiments of the hat 200A may include any style of headwear and/or accessory that can be worn on a person's head that is known or developed in the future similar to the various embodiments of the hat 100A-100L.

In various embodiments, hat 200A includes a coupling mechanism to attach one or more portions of the portion 204 to the portion 206. The coupling mechanism may include any suitable mechanism that is known or developed in the future capable of coupling the portion 204 and the portion 206.

In the embodiment shown in FIG. 2A, the coupling mechanism includes a set of loops 203 and a set of clasps 205 that can engage one another to couple the portion 204 to the portion 206. While a loop/clasp coupling mechanism is shown in FIG. 2A, the various embodiments of hat 200A are not limited to such. That is, other embodiments may employ other suitable coupling mechanisms. Other coupling mechanisms can include, but are not limited to, Velcro®, a re-useable adhesive material, and/or button/aperture mechanism, etc., among other coupling mechanisms that are possible and contemplated herein.

During use, a person can place a ponytail or other hair style through the port 202. Further, as one or more paired hook 203/clasps 205 are engaged, one or more additional ports 202 can be created. As such, a person can place a ponytail or other hair style through the port(s) 202.

Figure 2B:
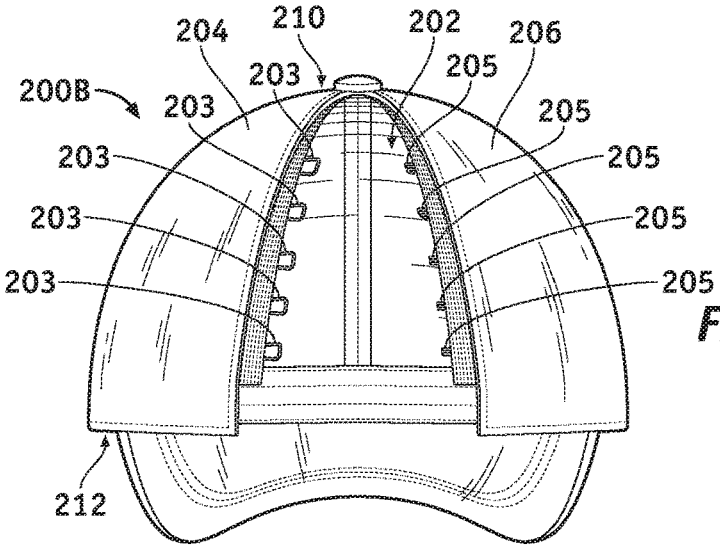

With reference to FIG. 2B, FIG. 2B is a diagram of another embodiment of a hat 200B. The hat 200B includes portions 204 and 206, hooks 203, clasps 205, crown 210, and bottom 212 similar to hat 200A discussed above.

Further, hat 200B includes at least one port 202 and the ability to include multiple ports 202 when one or more pairs of hooks 203 and clasps 205 are engaged. During use, a person can place a ponytail or other hair style through the port(s) 202 that are created by the coupling mechanism in hat 200B.

Figure 2C:
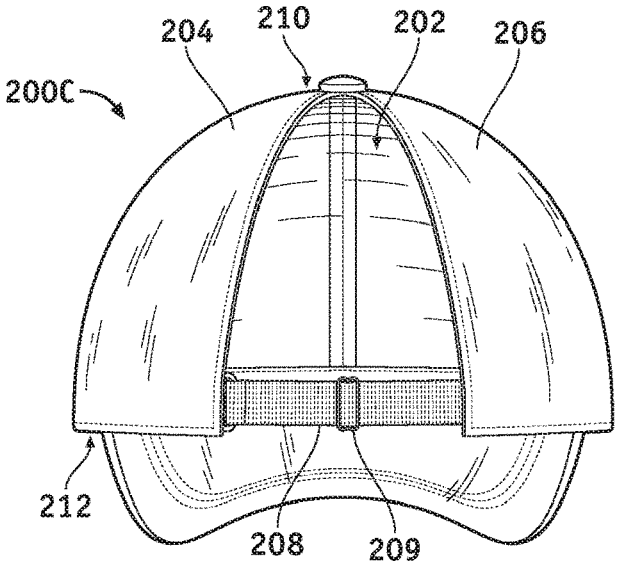

Referring to FIG. 2C, FIG. 2C is a diagram of another embodiment of a hat 200C. The hat 200C includes portions 204 and 206, crown 210, bottom 212, and at least one port 202 similar to hat 200A discussed above. In addition, the hat 200C includes a strap 208 and an adjustment mechanism 209 similar to the hat 200A discussed above.

Figure 3A:
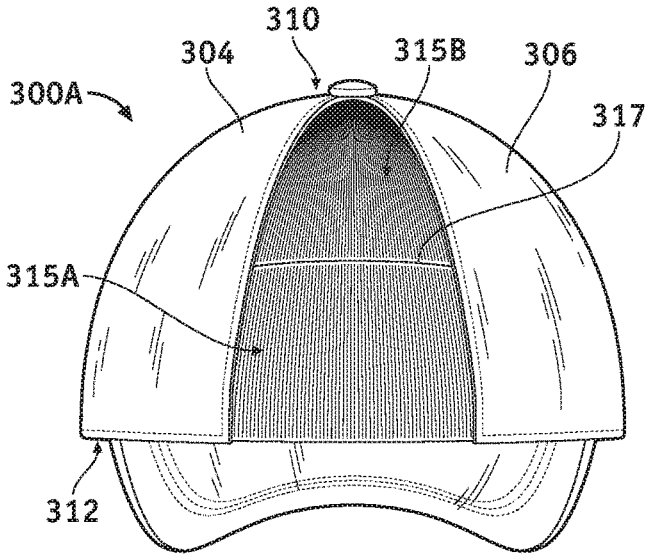
FIGS. 3A and 3B are diagram illustrating still various other embodiments of headwear including one or more hair ports.

With reference to FIG. 3A, FIG. 3A is a diagram of yet another embodiment of a hat 300A (e.g., a piece of headwear). At least in the illustrated embodiment, the hat 300A includes, among other components, a crease 317.

The crease 317 defines a gap or space between a band 315A and a band 315B, which can also be referred to as straps 315A and 315B, within which a ponytail or other hairstyle of a person wearing the hat 300A can be placed there through. The crease 317 can be in an open position when a ponytail or other hairstyle of a person wearing the hat 300A resides in the space of the crease 317. Further, the crease 317 can be in a closed position when the space of the crease 317 is vacant (e.g., a ponytail and/or other hair style does not reside therein).

In various embodiments, the band 315A, the band 315B, and the crease 317 may be bound by portions 304 and 306 of the hat 300A. The bands 315A and 315B may include and/or be formed of any suitable material or combination of materials that is known or developed in the future capable of connecting portions 304 and 306 to one another. In some embodiments, the band 315A and/or 315B may include a static material or a flexible/elastic material.

In embodiments employing a flexible/elastic band 315A and/or 315B, the band 315A and/or 315B can allow the space between the bands 315A and 315B defining the crease 317 to be adjusted. The size/area of the crease 317 can be adjustable depending upon the size/amount of hair in a person's ponytail and/or hairstyle. During use, a person can place a ponytail or other hair style through the crease 317.

The crease 317 may be included at any location on the hat 300A. In various embodiments, the crease 317 is located at the back/rear or substantially the back/rear of the hat 300A to accommodate a ponytail, which is typically worn/styled on the back/rear of a person's head. The crease 317 may be included anywhere between the crown 310 and the bottom 312 of the hat 300A. In various embodiments, the crease may be located at a position that is equidistant from the crown 310 and the bottom 312, at a position that is closer to the crown 310 than the bottom 312, or at a position that is closer to the bottom 312 than the crown 310.

The hat 300A, including the portions 304 and 306, may include any suitable material or combination of materials that is known or developed in the future similar to the various embodiments of the hats 100A through 100L and the hats 2A through 2C. Similarly, while the hat 300A is illustrated as a ball cap, various other embodiments of the hat 300A may include any style of headwear and/or accessory that can be worn on a person's head that is known or developed in the future similar to the various embodiments of the hats 100A through 100L and the hats 2A through 2C.

Figure 3B:
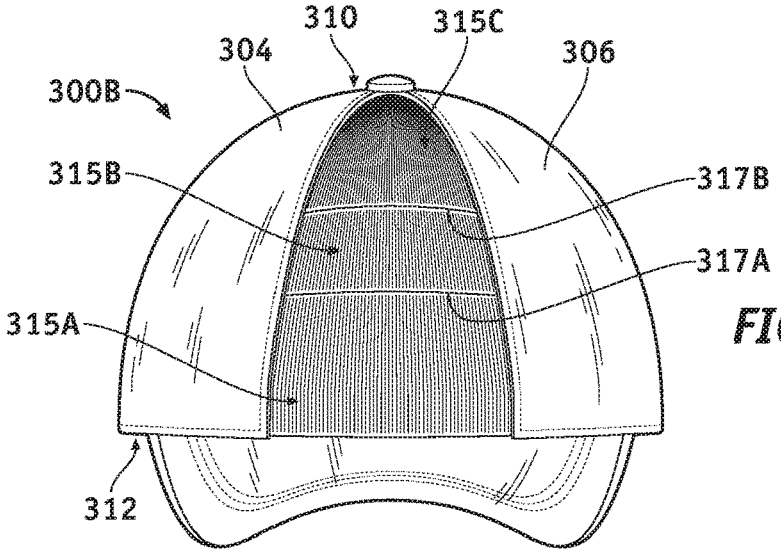

Referring to FIG. 3B, FIG. 3B is a diagram of another embodiment of a hat 300B (e.g., a piece of headwear). At least in the illustrated embodiment, the hat 300B includes, among other components, a crease 317A and a crease 317B.

The crease 317A defines a gap or space between a band 315A and a band 315B, which can also be referred to as straps 315A and 315B, within which a ponytail or other hairstyle of a person wearing the hat 300B can be placed there through. Similarly, the crease 317B defines a gap or space between a band 315C, which can be referred to a strap 315C, and the band 315B within which a ponytail or other hairstyle of a person wearing the hat 300B can be placed there through.

The creases 317A and 317B can be in an open position when a ponytail or other hairstyle of a person wearing the hat 300A resides in the space of the crease 317A and 317B. Further, the crease 317A and 317B can be in a closed position when the space of the crease 317A and 317B is vacant (e.g., a ponytail and/or other hair style does not reside therein).

In various embodiments, the band 315A, the band 315B, the band 315C, the crease 317A, and the crease 317B may be bound by portions 304 and 306 similar to the hat 300A discussed above. The bands 315A, 315B, and 315C may include and/or be formed of any suitable material or combination of materials that is known or developed in the future capable of connecting portions 304 and 306 to one another. In some embodiments, the band 315A, 315B, and/or 315C may include a static material or a flexible/elastic material.

In embodiments employing a flexible/elastic band 315A, band 315B, and/or 315C, the band 315A, 315B, and/or 315C can allow the spaces between the bands 315A, 315B, and 315C defining the creases 317A and 317B to be adjusted. The size/area of the creases 317A and 317B can be adjustable depending upon the size/amount of hair in a person's ponytail and/or hairstyle. During use, a person can place a ponytail or other hair style through the crease 317A and/or 317B.

Creases 317A and 317B may be included at any location on the hat 300A. In various embodiments, the creases 317A and 317B are located at the back/rear or substantially the back/rear of the hat 300A to accommodate a ponytail, which is typically worn/styled on the back/rear of a person's head. The creases 317A and 317B may be included anywhere between the crown 310 and the bottom 312 of the hat 300A.

In various embodiments, the crease 317A may be located at a position that is equidistant from the crown 310 and the bottom 312, at a position that is closer to the crown 310 than the bottom 312, or at a position that is closer to the bottom 312 than the crown 310. Similarly, the crease 317B may be located at a position that is equidistant from the crown 310 and the bottom 312, at a position that is closer to the crown 310 than the bottom 312, or at a position that is closer to the bottom 312 than the crown 310 provided that the creases 317A and 317B are not located at the same position on the hat 300B.

The hat 300B, including the portions 304 and 306, may include any suitable material or combination of materials that is known or developed in the future similar to the hat 300A. Further, while the hat 300B is illustrated as a ball cap, various other embodiments of the hat 300B may include any style of headwear and/or accessory that can be worn on a person's head that is known or developed in the future similar to the hat 300A.

Figure 4:
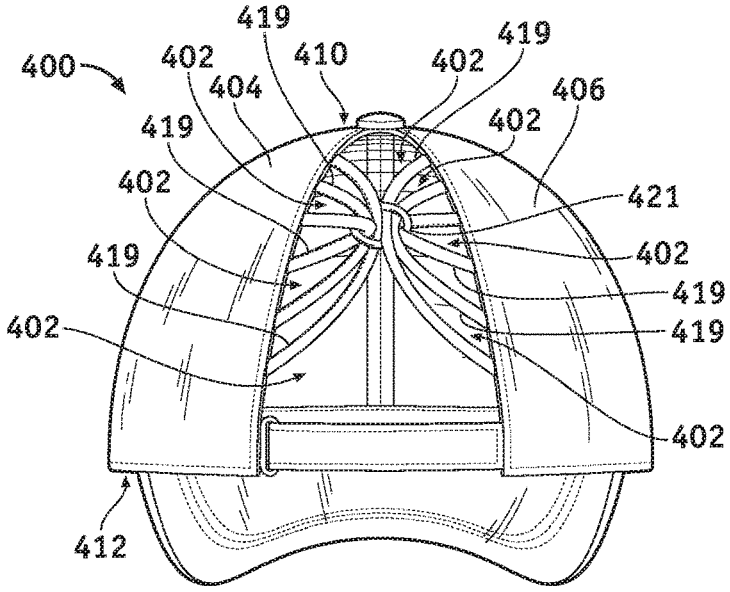
FIG. 4 is a diagram of yet another embodiment of headwear including one or more hair ports.

With reference to FIG. 4, FIG. 4 is a diagram of still another embodiment of a hat 400. At least in the illustrated embodiment, the hat 400 includes, among other components, a set of cords 419 harnessed by a slide 421. The cords 419 may also be referred to as straps, strings, strands, and/or other suitable structure.

The set of cords 419 may include any suitable quantity of cords 419 greater than or equal to two (2) cords 419. A cord 419 may include any suitable size, length, diameter, dimensions, and/or shape capable of performing the functions set forth herein. Further, a cord 419 may include and/or be formed of any suitable material and/or combination of materials capable of performing the functions set forth herein.

A slide 421 may include any suitable size, dimensions, and/or shape capable of performing the functions set forth herein. Further, a slide 421 may include and/or be formed of any suitable material and/or combination of materials capable of performing the functions set forth herein. At least in the illustrated embodiment, the slide 421 comprises a ring, among other structures that are possible and contemplated herein.

The space between each pair of cords 419 defines a port 402 similar to the various ports discussed above (e.g., port(s) 102 and port(s) 202). The slide 421 can be moved along an axis of each respective cord 419 to adjust the size and/or shape of one or more ports 402. That is, adjusting the position of the slide 421 along the cords 419 can increase/decrease the size and/or change the shape of multiple ports 402.

The size/area of each port 402 can be adjusted (e.g., via moving, positioning, and/or re-positioning the slide 421) depending upon the size of a person's head, the amount of hair on a person's head, and/or the size/amount of hair in a person's ponytail. During use, a person can place a ponytail or other hair style through one or more of the ports 402.

In various embodiments, the set of cords 419 and the slide 421 may be bound by portions 404 and 406 of the hat 400. The portions 404 and 406 may include any suitable material or combination of materials that is known or developed in the future similar to the various embodiments of the hats 100A through 100L, the hats 2A through 2C, and/or the hats 300A and 300B. Similarly, while the hat 400 is illustrated as a ball cap, various other embodiments of the hat 400 may include any style of headwear and/or accessory that can be worn on a person's head that is known or developed in the future similar to the various embodiments of the hats 100A through 100L, the hats 2A through 2C, and/or the hats 300A and 300B.

While the various embodiments have been discussed herein as including a specific quantity of straps 108, crisscross 114 of straps, hooks 203, clasps 205, hook 203/clasp 205 pairs, straps 208, bands 315, creases 317, cords 419, and/or slide 421, the various embodiments are not limited to such quantities. That is, the scope of the various embodiments discussed herein can include a greater quantity or smaller quantity of straps 108, crisscross 114 of straps, hooks 203, clasps 205, hook 203/clasp 205 pairs, straps 208, bands 315, creases 317, cords 419, and/or slides 421.

While the various embodiments have been discussed herein as including a specific quantity of straps 108, crisscross 114 of straps, hooks 203, clasps 205, hook 203/clasp 205 pairs, and/or straps 208, the various embodiments are not limited to such quantities. That is, the scope of the various embodiments discussed herein can include a greater quantity or smaller quantity of straps 108, crisscross 114 of straps, hooks 203, clasps 205, hook 203/clasp 205 pairs, and/or straps 208.

In addition, while various embodiments of hats 100A through 100L show strap 108 and crisscrosses 114 as including one or more elastic straps, these embodiments are not limited to being elastic. That is, various embodiments of hats 100A through 100L may include one or more adjustment mechanisms similar to adjustment mechanism 209 discussed with reference to hats 200A and 200C to accommodate various head sizes of a user.

Similarly, while various embodiments of hat 200A and/or 200C may include one or more straps 208 with an adjustment mechanism 209, these embodiments are not limited to such configurations. That is, various embodiments of hat 200A and/or 200C may include one or more straps 208 including and/or formed of an elastic material with or without an adjustment mechanism 209 to accommodate various head sizes of a user similar to strap(s) 108 discussed elsewhere herein.

In summary, various embodiments provide a hat 100, 200, 300, and 400 including one or more ports 102, 202, 315, and 402. One hat includes a first portion, a second portion, and a set of straps coupling the first portion and the second portion. Here, the set of straps, the first portion, and the second portion create a set of ports located at a rear portion of the hat and extending from a crown of the hat to a bottom of the hat. Further, at least one port in the set of ports includes a size that allows hair of a person to be placed there through.

In a further embodiment, the set of straps includes a single strap in which the single strap is located at the bottom of the hat and is coupled the first portion and the second portion and the set of ports includes a single port that extends from the crown of the hat to the strap. In additional or alternative embodiments, the set of straps includes a single strap in which the single strap is coupled the first portion and the second portion, the single strap is located closer to the crown of the hat than to the bottom of the hat, and the set of ports includes a single port that extends from the crown of the hat to the strap.

In further additional or alternative embodiments, the set of straps includes a single strap in which the single strap is coupled the first portion and the second portion, the single strap is located closer to the bottom of the hat than to the crown of the hat, and the set of ports comprises a single port that extends from the crown of the hat to the strap. In still further additional or alternative embodiments, the set of straps includes a single strap in which the single strap is coupled the first portion and the second portion, the single strap is located equidistant from the crown of the hat and the bottom of the hat, and the set of ports includes a single port that extends from the crown of the hat to the strap.

In yet further additional or alternative embodiments, the set of straps includes a first strap located adjacent to a bottom of the hat and a second strap, the set of ports includes a first port and a second port, and the first port and the second port include respective sizes that allows the hair of the person to be placed there through. In some embodiments, the second strap defines a boundary between the first port and the second port. In some further embodiments, the second strap is located closer to the crown of the hat than to the bottom of the hat, closer to the bottom of the hat than to the crown of the hat, or equidistant from the crown of the hat and the bottom of the hat.

In additional or alternative embodiments, the set of straps includes a plurality of straps in which the set of ports includes a plurality of ports and each port in the plurality of ports includes a respective size that allows the hair of the person to be placed there through. In some embodiments, the plurality of ports includes a first port and a second port, the first port is located toward the crown of the hat, the second port is located toward to the bottom of the hat, and at least one strap in the plurality of straps defines a boundary between the first port and the second port. In some further embodiments, the plurality of straps includes two or more straps spaced apart and horizontally oriented with respect to one another, a first strap in the plurality of straps is located closer to the crown of the hat than a second strap in the plurality of straps, and the second strap is located closer to the bottom of the hat than the first strap.

In additional or alternative embodiments, the plurality of straps includes a set of crisscrossed straps. In some embodiments, a strap in the set of crisscrossed straps includes a first layer and a second layer in which the first layer is coupled to the first portion of the hat, the second layer is coupled to the second portion of the hat, the second layer is configured to lay over at least a portion of the first layer, and the second layer is releasably coupleable to the first layer to allow a size of the hat to be adjusted. In some embodiments, the size includes a circumference of the hat, a volume of the hat, or both the circumference and the volume of the hat.

In various additional or alternative embodiments, the set of crisscrossed straps includes a first pair of crisscrossed straps and a second pair of crisscrossed straps. In some embodiments, the first pair of crisscrossed straps is located closer to the crown of the hat than the second pair of crisscrossed straps and the second pair of crisscrossed straps is located closer to the bottom of the hat than the first pair of crisscrossed straps.

In various further additional or alternative embodiments, the set of straps includes a first strap and a second strap in which a single port of the set of ports defines a crease between the first strap and the second strap and the crease is adjustable between an open position when the hair of the person occupies a space there through and a closed position when the space is vacant. In still further additional or alternative embodiments, the set of straps includes a plurality of straps in which a first port of the set of ports defines a first crease between a first strap and a second strap of the plurality of straps, a second port of the set of ports defines a second crease between a third strap of the plurality of straps and the second strap, and the first crease and the second crease are adjustable between an open position when the hair of the person occupies a space there through and a closed position when the space is vacant.

In some embodiments, the set of straps includes a plurality of straps including at least a first strap and a second strap and the hat further includes a slide coupling the first strap and the second strap together, and the slide is moveable along an axis of each of the plurality of straps to adjust a respective size of each port in the set of ports. In some embodiments, the slide includes a ring structure.

The various embodiments discussed herein may be practiced in other specific forms and the described embodiments are to be considered in all respects only as illustrative, and not restrictive. The scope of the technology is, therefore, indicated by the appended claims rather than by the foregoing description. All changes that come within the meaning and range of equivalency of the claims are to be embraced within their scope. That is, one of ordinary skill in the art will appreciate that modifications and/or adaptations to the various aspects may be made without departing from the scope of the present technology, as set forth in the following claims.

The invention claimed is:

1. A hat, comprising:

a first portion;

a second portion; and a plurality of straps coupling the first portion and the second portion, wherein:

the plurality of straps comprises a first pair of crisscrossed straps including a top strap and a bottom strap, the top strap in the first pair of crisscrossed straps comprises a top layer and a bottom layer, wherein the top layer is detachably coupleable to the bottom layer, the plurality of straps, the first portion, and the second portion create a plurality of ports located at a rear portion of the hat and extending from a crown of the hat to a bottom of the hat, and each port in the plurality of ports is open to an interior of the hat and includes a size that allows hair of a person to be placed from the interior of the hat through each port in the plurality of ports.

2. The hat of claim 1, wherein:

the plurality of straps further comprises a third strap located below the first pair of crisscross straps and adjacent to the bottom of the hat;

the plurality of ports comprises at least a first port and a second port; and the first port and the second port include respective sizes that allows the hair of the person to be placed there through.

3. The hat of claim 2, wherein the first pair of crisscross straps defines a boundary between the first port and the second port.

4. The hat of claim 3, wherein the first pair of crisscross straps is located at one of:

closer to the crown of the hat than to the bottom of the hat;

closer to the bottom of the hat than to the crown of the hat; and equidistant from the crown of the hat and the bottom of the hat.

5. The hat of claim 4, wherein:

the plurality of ports further comprises a third port and a fourth port;

the first port is located toward the crown of the hat;

the second port is located toward to the bottom of the hat;

the third port is located toward a left side of the hat; and the fourth port is located toward a right side of the hat.

6. The hat of claim 1, wherein:

the top layer of the top strap is detachably coupleable to the bottom layer of the top strap via a hook and loop mechanism; and the hook and loop mechanism on the top and bottom layers of the top strap allows a size of the hat to be adjusted.

7. The hat of claim 6, wherein the size comprises one of a circumference of the hat, a volume of the hat, and both the circumference and the volume of the hat.

8. The hat of claim 1, wherein:

the plurality of straps further comprises a second pair of crisscrossed straps;

the plurality of ports comprises at least a first port, a second port, and a third port;

the first port is located between the first and second pairs of crisscrossed straps;

the second port is located toward the crown of the hat; and the third port is located toward the bottom of the hat.

9. The hat of claim 8, wherein:

the first pair of crisscrossed straps is located closer to the crown of the hat than the second pair of crisscrossed straps; and the second pair of crisscrossed straps is located closer to the bottom of the hat than the first pair of crisscrossed straps.

10. The hat of claim 1, wherein the first pair of crisscross straps is located at one of:

closer to the crown of the hat than to the bottom of the hat;

closer to the bottom of the hat than to the crown of the hat; and equidistant from the crown of the hat and the bottom of the hat.

* * * * *